United States Patent [19]

Jackson

[11] Patent Number: 4,531,444

[45] Date of Patent: Jul. 30, 1985

[54] WEAPON CHARGER

[75] Inventor: Theodore A. Jackson, Utica, Mich.

[73] Assignee: Ex-Cell-O Corporation, Troy, Mich.

[21] Appl. No.: 539,783

[22] Filed: Oct. 7, 1983

[51] Int. Cl.[3] ..... F41D 5/02

[52] U.S. Cl. ..... 89/1.4

[58] Field of Search ..... 89/1 K, 36 K, 34

[56] References Cited

U.S. PATENT DOCUMENTS

| | | | |
|---|---|---|---|
| 2,332,631 | 10/1943 | Gasser | 89/1 K |
| 2,389,737 | 11/1945 | Neuschotz | 89/1 K X |
| 2,406,461 | 8/1946 | Hammell | 89/1 K |
| 2,649,840 | 8/1953 | Davidson | 89/36 K X |
| 2,717,532 | 9/1955 | Ramseyer | 89/1 K |
| 2,847,908 | 8/1958 | Boals | 89/1 K |
| 2,951,422 | 9/1960 | Bobkowski | 89/34 X |
| 3,566,744 | 3/1971 | Stoner | 89/1 K X |

*Primary Examiner*—David H. Brown

*Attorney, Agent, or Firm*—Edward J. Timmer

[57] ABSTRACT

The weapon charger for a combat vehicle includes a charger slide means in the weapon mantlet adapted to slide to a rearward position to engage and cock the weapon sear block and to a forward position to disengage from the sear block. The charger slide means is slid by means of a chain means connected thereto extending through the mantlet into the turret of the vehicle and driven by a hand crank actuated spur gear inside the turret. The crank is rotated clockwise to pull the charger slide means rearwardly to cock the sear block. A return spring means attached to the charger slide means pulls same to its forward position when the crank means is rotated counterclockwise.

8 Claims, 3 Drawing Figures

WEAPON CHARGER

FIELD OF THE INVENTION

The present invention relates to devices for charging the first round in self-loading weapons, such as a machine gun mounted on an armored vehicle.

BACKGROUND OF THE INVENTION

Devices for charging self-loading weapons are known in the art. For example, the Ramseyer U.S. Pat. No. 2,717,532 issued Sept. 13, 1955 discloses a cocking device for a self-loading firearm wherein a catch on a slidable charger block engages an abutment on a slidable breech block as the charger block is pulled rearwardly by a cable. Once the breech block is in cocked position, a return spring biases the charger block back to a forward position disengaged from the breech block.

The Boals U.S. Pat. No. 2,847,908 issued Aug. 19, 1958 describes an automatic charger for a gun. The charger includes a hydraulically operated unit supported on the side of a machine gun. The unit includes a piston with a pivotal lug thereon adapted to engage the breech block slide when the piston is moved rearwardly.

An automatic recharger for a machine gun is illustrated in the Hammell U.S. Pat. No. 2,406,461 issued Aug. 27, 1946. The recharger includes a chain and sprocket mechanism driven by an electric motor with the chain carrying a lug adapted to engage the bolt of the gun and retract it for charging as the chain is driven around a triangular pattern of sprockets.

The Davidson U.S. Pat. No. 2,649,840 issued Aug. 25, 1953 and the Bobkowski U.S. Pat. No. 2,951,422 issued Sept. 6, 1960 describe automatic systems for feeding ammunition to weapons.

A remote cable arrangement for holding a cartridge in a withdrawn position from the firing chamber of a machine gun or cannon is described in the Neuschotz U.S. Pat. No. 2,389,737 issued Nov. 27, 1945. The cartridge withdrawal mechanism includes a plurality of drums each having a control cable wound thereon and attached to a weapon and a hand crank and a releaseable latch mechanism to maintain the withdrawn cartridge position until the weapon is to be fired.

SUMMARY OF THE INVENTION

The present invention provides a charger apparatus especially adapted for actuating the sear block of a weapon from inside a combat vehicle and also for returning the charger to its original position prior to the weapon being fired.

The charger apparatus in a typical working embodiment comprises a charger slide means adapted to engage the sear block of the weapon as the charger slide means is slid to a rearward position. The charger slide means is connected to chain means which in turn is driven rearwardly by a spur gear means turned by a stowable crank means connected thereto inside the turret of the vehicle. The crank means is rotated clockwise to pull the charger slide means rearwardly and cock the sear block. A return spring means is attached to the opposite end of the charger slide means and pulls the charger slide means and chain means forwardly to their beginning position when the crank means is rotated counterclockwise.

In a preferred embodiment of the invention, the chain means extends through a slotted tube mounted in the weapon mantlet and into the turret. The chain means is also guided by a pair of opposed roller means mounted on a bracket on the mantlet.

The crank driven spur gear means is mounted inside the turret of an armored personnel carrier or other combat vehicle for activation by the operator from inside the vehicle and meshes with the chain means to actuate same.

In another preferred embodiment, the charger slide means includes a charger slide member having the return spring means attached at its forward end and the chain means attached at the rearward end and further includes a slidable charger block coupled to the slide member. The charger block, in turn, is engaged to the sear block when it is moved to the rearward position and disengaged therefrom when moved to its original forward position.

DESCRIPTION OF PREFERRED EMBODIMENTS

Figure 1:
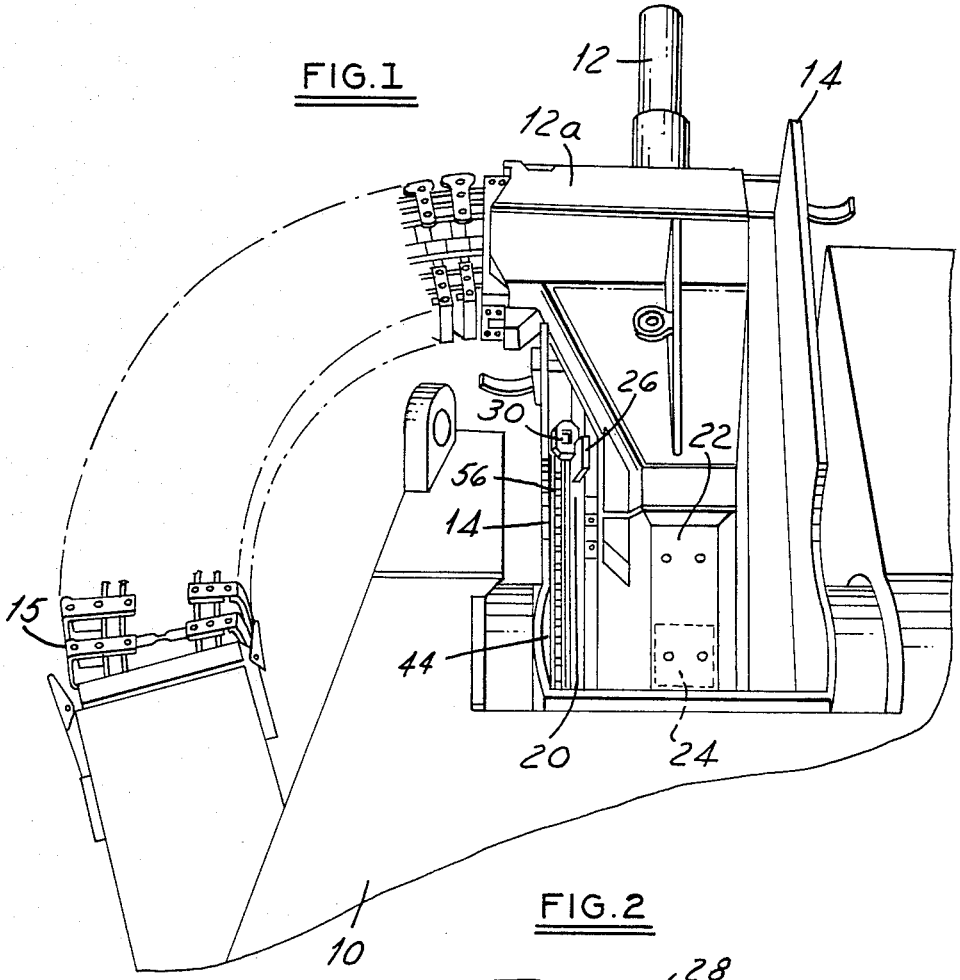
FIG. 1 is a partial perspective showing a machine gun mounted in the mantlet on the turret of an armored vehicle and specifically the components of the charger apparatus located in the forward sector of the weapon mantlet.

Reference to FIG. 1 shows the forward portion of a rotatable turret 10 carried for example on an armored personnel carrier. Mounted on the turret is a machine gun 12 illustrated in FIG. 1 as being the well known 40 mm M-19 MOD III machine gun. The gun is mounted in a mantlet 14, as is well known, the top cover of which is removed in FIG. 1. The gun 12 is fed ammunition via a flex chute 15 from an ammunition storage box (not shown) inside the vehicle. The flex chute 15 connects to a top cover **12*a*** on the gun.

Figure 2:
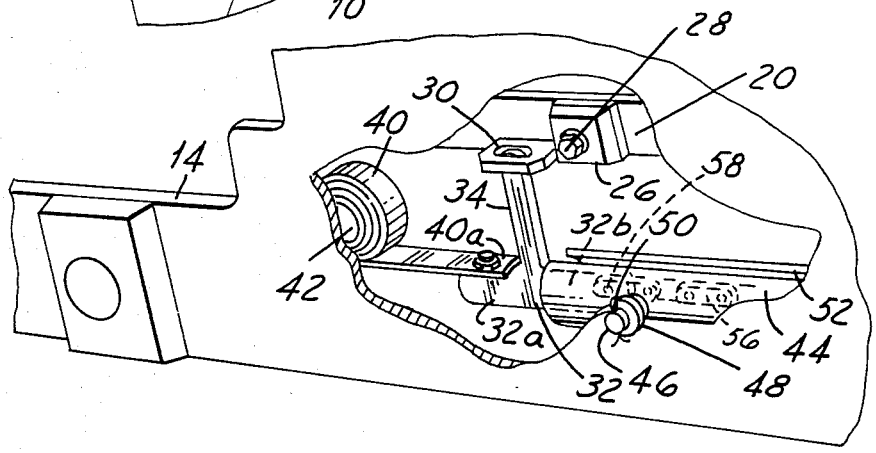
FIG. 2 is a partial enlarged somewhat exploded perspective showing the forward charger components in more detail.

In FIGS. 1 and 2, the forward components of the gun charger are shown. For example, the charger includes a charger block 20 which is slidably mounted in the machine gun receiver 22. The charger block 20 is engageable with the sear block 24 of the machine gun 12 when the charger block is moved from the forward position shown to a rearward position corresponding to a position where the sear block is cocked.

The charger block 20 is disengageable from the sear block when moved back to its original forward portion as is well known for the aforementioned machine gun.

As shown in FIG. 2, the charger block carries a flange 26 attached thereto as by bolt 28 and having an aperture 30. A charger slide member 32 includes a dog 34 extending upwardly and into the aperture 30 to place the slide member and charger block in engaged or coupled relationship such that the latter slides rearwardly or forwardly with the former.

As shown best in FIG. 2, the charger slide member 32 has a forward end **32*a* to which one end 40*a* of a coiled negator return spring 40 is attached. The spring is of the constant load type wound around a spool 42 rotatably mounted to the mantlet 14 by a pin (not shown). The return spring tends to assume the coiled state when unwound and thus biases the charger slide member 32 toward its forward position as will be explained more fully hereinafter. The rearward end 32***b* of the charger slide member extends into a guide tube 44 fastened to the mantlet 14 by a pin 46, washer 48 and cotter pin 50 at various, spaced apart locations along its length (only one shown). The tube 44 includes longitudinal slot 52 through which the dog 34 can slide rearwardly. Fastened to the rearward end 32*b* of the charger slide member is a feed chain 56 extending through the guide tube 44 and into the turret, FIG. 3. The chain is fastened to the rearward end 32*b* by a pin 58 for example or other appropriate means.

Figure 3:
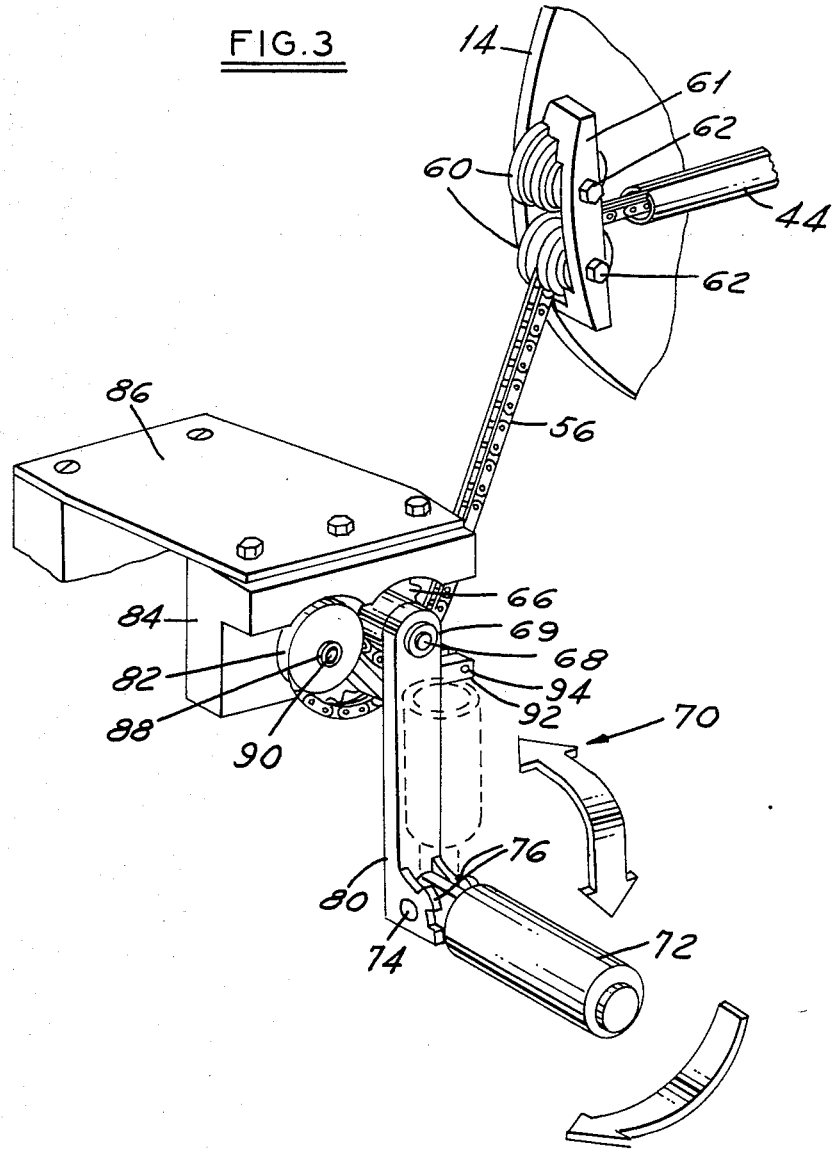
FIG. 3 is a partial perspective showing the components of the charger apparatus located inside the turret as well as the components in the rearward sector of the weapon mantlet.

Upon exiting the guide tube 44 inside the turret, the chain 56 passes between a pair of guide rollers 60 mounted to the mantlet by frame 61 and bolts 62. The chain extends downwardly into the turret to mesh with a spur gear 66 attached by shaft 68 and washer 69 to a crank 70 having a handle 72 pivotally connected thereto. As shown in FIG. 3, the handle 72 pivots about a pin 74 extending through side flanges 76 of the crank and can be stowed out of the way to the position indicated by phantom lines simply by pivoting the handle upwardly against the crank arm 80.

After passing the spur gear 66, the chain 56 passes around a second roller 82 rotatably mounted on flange 84 along with the spur gear. The flange 84 is in turn fastened to the turret by plate 86. A washer 88 and pin 90 are used to rotatably mount the second roller 82. The chain extends upwardly around the roller 82 and then back down under itself and is fastened at its free end to a bifurcated arm 92 extending from the flange 84 by any suitable means such as a pin 94.

Operation of the gun charger to charge the first round involves simply rotating the crank 70 clockwise to pull the chain 56 and slide member 32 to a rearward position at which the sear block is cocked. Excess chain pulled into the turret simply hangs beneath the spur gear 66 and roller 82. Then, before firing the gun, the crank is rotated counterclockwise to allow the return spring 40 to pull the charger slide 32, charger block 20 and chain 56 back to their original forward positions. The gun may then be fired and will continue in operation in the self-loading mode. During this time, the handle 72 is pivoted against the crank arm 80 to stow it out of the way.

While the gun charger of the invention has been described by a detailed description of certain specific and preferred embodiments, it is understood that various modifications and changes can be made in them within the scope of the appended claims which are intended to include equivalents of such embodiments.

I claim:

1. In an armored turret having a weapon with a sear block and a mantlet around the weapon on the turret, a weapon charger apparatus comprising a guide tube mounted in the mantlet and extending into the turret, a slide member slidably mounted in the guide tube, a charger block slidable in the mantlet to a rearward sear block cocking position and to a forward starting position away from the sear block, said slide member being coupled to said charger block to move same, a feed chain extending through the guide tube having one end connected to the rearward end of the slide member and having another end extending into the turret, a spur gear rotatably mounted in the turret and meshing with the feed chain, a manually-operable crank pivotably connected to the spur gear in the turret and rotatable clockwise to cause the spur gear to pull the feed chain toward the turret and rotatable counterclockwise, and a rotatable coiled flat spring mounted in the mantlet and connected to the forward end of the slide member to pull it and the feed chain to the forward position when the crank rotates the spur gear counterclockwise.

2. In a turret having a weapon with a sear means, a charger apparatus for activating the sear means comprising a slidable charger slide means for activating the sear means, chain means connected to said charger slide means, rotatable coiled flat return spring means connected to said charger slide means and disposed forwardly thereof to bias said charger slide means away from the sear means, gear means meshing with the chain means to pull the charger slide means rearwardly for activating the sear means with said return spring means rotatably uncoiling when the gear means is rotated in one direction and said gear means rotatable in the other direction to permit said return spring means to pull the charger slide means forwardly by virtue of the return spring means rotatably coiling.

3. The turret of claim 2 wherein the crank driven gear means is disposed inside a turret of the armored vehicle.

4. The turret of claim 2 wherein the charger slide means includes a charger block slidable rearwardly and forwardly in a mantlet around the weapon and a slide member coupled to the charger block to slide same forwardly or rearwardly, said slide member having said chain means connected at the rearward end thereof and the return spring means at the forward end thereof.

5. The turret of claim 2 wherein the chain means extends through a mantlet around the weapon and into the turret.

6. The turret of claim 5 wherein the chain means extends through a tubular guide means mounted in the mantlet.

7. The turret of claim 6 wherein a pair of opposed guide rollers is mounted on the mantlet for guiding the chain means.

8. In a weapon having a sear means, a charger apparatus for activating the sear means comprising a slidable charger slide means for activating the sear means, chain means connected to said charger slide means, rotatable coiled flat return spring means connected to said charger slide means and disposed forwardly thereof to bias said charger slide means away from the sear means, gear means meshing with the chain means to pull the charger slide means rearwardly for activating the sear means with said return spring means rotatably uncoiling when the gear means is rotated in one direction and said gear means rotatable in the other direction to permit said return spring means to pull the charger slide means forwardly by virtue of the return spring means rotatably coiling.

* * * * *